US005370804A

United States Patent [19]

Day

[11] Patent Number: 5,370,804

[45] Date of Patent: Dec. 6, 1994

[54] NEAT OIL FINISH WITH HIGH LUBRICANT CONTENT

[75] Inventor: Fleming H. Day, Greenville, N.C.

[73] Assignee: E. I. Du Pont de Nemours and Company, Wilmington, Del.

[21] Appl. No.: 126,662

[22] Filed: Sep. 27, 1993

Related U.S. Application Data

[63] Continuation of Ser. No. 837,743, Feb. 19, 1992, abandoned.

[51] Int. Cl.[5] ..... C10M 129/26; D06M 13/18; D06M 13/20

[52] U.S. Cl. ..... 252/41; 252/8.6; 252/56 S

[58] Field of Search ..... 252/41, 8.6, 56 S

[56] References Cited

U.S. PATENT DOCUMENTS

| | | | |
|---|---|---|---|
| 1,789,331 | 1/1931 | Becker | 252/41 |
| 2,298,432 | 10/1942 | Thompson | 252/8.6 |
| 3,039,895 | 6/1962 | Yuk | 252/41 |
| 3,223,623 | 12/1965 | Kubitz | 252/8.6 |
| 3,248,258 | 4/1966 | Coats | 117/138.8 |
| 3,277,000 | 10/1966 | Chandler | 252/8.9 |
| 3,311,691 | 3/1967 | Good | 264/290 |
| 3,503,880 | 3/1970 | McMicken | 252/8.6 |
| 3,563,892 | 2/1971 | Cooley | 252/8.7 |
| 3,575,856 | 4/1971 | Anton | 252/8.6 |
| 3,704,160 | 11/1972 | Steinmiller | 117/138.8 F |
| 4,442,249 | 4/1984 | Lees et al. | 523/455 |
| 4,900,496 | 2/1990 | Andrews | 264/103 |
| 4,920,000 | 4/1990 | Day | 428/391 |
| 4,946,375 | 8/1990 | Day | 428/395 |

FOREIGN PATENT DOCUMENTS

| | | |
|---|---|---|
| 0010328A1 | 10/1979 | European Pat. Off. . |
| 325938 | 1/1929 | United Kingdom . |
| 442653 | 7/1935 | United Kingdom . |

OTHER PUBLICATIONS

Kirk-Othmer Encyclopedia of Chemical Technology, 3rd Edition, 1979, vol. 8, p. 47.

*Primary Examiner*—Margaret Medley

[57] ABSTRACT

A lubricating finish composition and synthetic filaments coated with the composition. The composition of the invention comprises: about 80 to about 99 weight percent lubricant; and about 1 to about 20 weight percent sodium or potassium alkali metal salt of a branched or unbranched aliphatic monocarboxylic acid having at least 8 carbon atoms. The finish composition is a liquid at a temperature below about 150° C.

15 Claims, No Drawings

NEAT OIL FINISH WITH HIGH LUBRICANT CONTENT

This is a continuation, of application Ser. No. 07/837,743 filed Feb. 19, 1992, now abandoned.

BACKGROUND OF THE INVENTION

The present invention relates to finish compositions for use with synthetic filaments and relates more particularly to a neat oil finish composition and synthetic filaments coated with such composition.

Known neat oil finishes typically used for polyamide and polyester yarns contain high percentages of nonionic surfactants, e.g., 30 weight percent, which provide good dissipation of electrostatic charge, filament bundle cohesion, and desirable wetting properties to the yarn. Unfortunately, such high percentages of nonionic surfactants in the finish can be disadvantageous since they generally increase the finish viscosity which makes uniform application of finish difficult. Also, nonionic surfactants increase the propensity of the finish to undergo oxidative degradation and to fume when exposed to heat. The disadvantages become particularly apparent when such finishes are used as "spin finishes" in the manufacture of high tenacity polyamide and polyester industrial yarns where high draw ratios and high temperatures are used.

The presence of nonionic surfactants in neat oil finishes can also cause problems when a yarn is to be used in woven fabrics. Nonionic surfactants are sometime incompatible with size, especially polyacrylic acid size, and thus nonionic surfactant can cause sizing, weaving, and scouring problems for fabric makers.

To improve application uniformity of high viscosity neat oil finishes containing nonionic surfactants, low molecular weight diluents like mineral spirits are sometimes added to reduce finish viscosity. However, these diluents can introduce fire and explosion hazards since they increase finish fuming and may also cause health and environmental problems. Using higher finish application temperatures to reduce viscosity is not a desirable practice with finishes containing high percentages of nonionic surfactants since increased thermal degradation will result. If it is attempted to reduce the nonionic surfactant content to a lower percentage, e.g., 5 weight percent by substitution with additional lubricant, the resulting finish provides poor electrostatic protection during yarn manufacture and in end-use processing.

SUMMARY OF INVENTION

The invention provides a lubricating finish composition and synthetic filaments coated with the composition. The composition of the invention comprises:

about 80 to about 99 weight percent lubricant; and about 1 to about 20 weight percent alkali metal salt of a branched or unbranched aliphatic monocarboxylic acid having at least 8 carbon atoms. The finish composition is a liquid at a temperature below about 150° C.

The lubricant preferably is selected from the class consisting of natural and synthetic esters and natural and synthetic hydrocarbons having a number average molecular weight of at least about 550 atomic mass units (amu) and having an iodine value of less than about 15. In a preferred embodiment in accordance with the invention, the finish composition is substantially free of nonionic surfactants. Preferably, the branched or unbranched aliphatic monocarboxylic acid of the salt has at least about 14 carbon atoms.

In accordance with the invention, the lubricating finish is advantageously used as a neat oil finish for synthetic filaments including polyamide and polyester multifilament yarns and is particularly useful as a "spin finish" for industrial yarns. The finish of the invention provides electrostatic protection while avoiding the high viscosity problems associated with the use of high percentages of nonionic surfactants. Moreover, preferred finish compositions which contain optional stabilizers provide dramatically improved thermal-oxidative stability as measured in an oven varnish test. The preferred finish compositions also exhibit low fuming. The finish compositions can easily be made compatible with polyacrylic acid size when the yarns are to be used in woven fabrics.

DETAILED DESCRIPTION

The finish composition includes about 80 to about 99 weight percent lubricant, preferably about 85 to about 98 weight percent lubricant. The lubricant should be a lubricant or mixture of lubricants suitable for use in a neat oil finish and thus should not fume excessively on hot machine parts during spinning of yarns or in subsequent end-use processing. Preferably, the lubricant is selected from the class consisting of natural and synthetic esters and natural and synthetic hydrocarbons having a number average molecular weight of at least about 550 amu.

The lubricant used can be a liquid at or below room temperature for ease of handling and consistent end-use performance even at low temperatures. However, for some end-use applications, solid lubricants that melt at or above room temperature may be desirable. In any event, the melting point of the lubricant must not be too high since it is necessary for the finish composition to be a liquid at a temperature below about 150° C. in order for the composition to be an effective neat oil finish. For resistance to oxidative degradation, especially varnishing during high temperature processing, the lubricant should be low in unsaturation. Preferably, unsaturation as measured by iodine value is less than about 15. Some examples of suitable natural and synthetic ester lubricants include mono-, di-, and poly- esters such as pentaerythritol tetrapelargonate, coconut oil, neopentyl glycol diisostearate, and stearyl stearate. Examples of suitable natural and synthetic hydrocarbons are mineral oil and poly $\alpha$-olefins, e.g., hydrogenated decene tetramer.

The finish composition also includes about 1 to about 20 weight percent of alkali metal salt of a branched or unbranched aliphatic monocarboxylic acid having at least 8 carbon atoms, preferably at least 14 carbon atoms. For convenience, the alkali metal salt of a branched or unbranched aliphatic monocarboxylic acid having at least 8 carbon atoms will hereinafter be referred to as "soap". Preferably, the composition includes about 2 to about 15 weight percent soap.

The soap can be provided by a single soap or can be a mixture such as the soaps which result when the monocarboxylic acid used to make the soap is from a natural source or a fraction thereof. The soap can also be a tailored mixture adapted for a particular end use. In addition, it is preferable for the branched or unbranched monocarboxylic acids of the soaps to contain no more than one carbon-carbon double bond to improve resistance to oxidative degradation.

It is necessary to employ soaps in the composition which make the composition a liquid at a temperature below about 150° C. so that the composition will be a liquid at the temperature of application to a filament. Temperatures of application of neat oil finish can range from about 25° C. to 150° C. with preferred temperatures of application being from about 50° C. to about 100° C. Preferably, therefore, the finish composition is a liquid at a temperature below about 100° C. A wide variety of soaps are useful in accordance with the invention, for example, potassium stearate, potassium isostearate, sodium stearate and sodium isostearate. However, some soaps may be difficult to use, particularly depending on the alkali metal hydroxide used to make them, since the soaps may cause gelation of the compositions. Soaps which are potassium salts and mixtures of potassium salts with other alkali metal salts are preferred.

Soap in the finish serves as a surfactant and antistat and thus it dissipates accumulated electrostatic charges on the yarn threadline during yarn manufacturing and end-use processing.

The soap can be added to and mixed with other finish components to provide the finish composition or preferably is made in situ by adding the alkali metal hydroxide to stirred monocarboxylic acids mixed together with one or more of the other finish components, i.e., lubricant, nonionic surfactant (if present) and stabilizer (if present). However, it is usually undesirable for the amount of lubricant present during in situ preparation to be substantially greater than the amount of monocarboxylic acid present since too much lubricant can hamper proper mixing and solids may form when the alkali metal hydroxide is added. After the soap is prepared, all, or the remaining portion of the lubricant, can then be added and mixed to form the finish composition.

For in situ preparation, the alkali metal hydroxide should be dissolved in water to facilitate the neutralization reaction. However, the concentration of the alkali metal hydroxide should be sufficiently high that the amount of water remaining in the finish is not high enough to cause phase separation in the resulting finish. Alternately, if a low concentration of alkali metal hydroxide is used, excess water could be removed after neutralization to improve finish homogeneity. A suitable concentration of alkali metal hydroxide to avoid having to remove water is in the range of about 45–55% by weight. When two alkali metal hydroxides are used to form the soap, they can be added together or in sequence as may be desired.

Finish compositions in accordance with the invention may incorporate soaps which are completely neutralized or which contain excess monocarboxylic acid or excess alkali metal hydroxide. For most applications, it is believed to be desirable to use excess monocarboxylic acid to achieve finish homogeneity and avoid finish gelation or to provide low levels of irritation to satisfy occupational health concerns. On the other hand, it may be desirable to provide a very slight excess of alkali metal hydroxide to maximize oxidative stability of the finish if no phase separation or high viscosity problems are encountered. With in situ preparation of the soap, the desired soap can conveniently be prepared by adjusting the proportions of the monocarboxylic acid and the alkali metal hydroxide.

It is preferred for finishes in accordance with the present invention to be substantially free of nonionic surfactants. However, the finish compositions may optionally contain nonionic surfactants in an amount not more than about 5 weight percent for the purpose of improving end use performance. Usually, the amount of nonionic surfactant must be greater than 0.1 percent to have any significant effect. Examples of possible nonionic surfactants are ethoxylated carboxylic acids and ethoxylated alcohols. When nonionic surfactants are present in sufficient quantity, they can be a suitable reaction medium for in situ soap preparation and little or no lubricant need be added until the soap has been formed.

The finish composition preferably comprises a stabilizer in the amount of about 0.05 to 5 weight percent to provide additional thermal-oxidative stability. The stabilizer can be a single compound such as an antioxidant or can be a stabilizer package containing an antioxidant together with additional materials for the purpose of enhancing oxidative stability. Provided that they enhance finish properties, any of a wide variety of stabilizers known for use in finishes can be used in a finish in accordance with the present invention. An example of a stabilizer advantageously used in accordance with the present invention is a stabilizer package of trilaural phosphite and polydimethyl siloxane.

In accordance with the invention, the finish composition is used as a neat oil to coat synthetic filaments, i.e., the finish composition contains less than about 5 weight percent water when applied. The finish is preferably used with filaments of a polymer selected from the class consisting of polyamide homopolymers and copolymers and polyester homopolymers and copolymers. While the finish has a number of potentially beneficial applications, the finish is well suited for use as "spin finish" when applied to an as-spun multifilament yarn which is subsequently drawn, particularly when high draw ratios and high temperatures are employed. The finish may be applied by any of a variety of known methods for applying neat oil finishes such as using a rotating roll or metering tip applicator. The finish composition is preferably applied at a temperature of about 25° C. to about 150° C., most preferably, about 50° C. to about 100° C. Preferably, the amount of finish applied is about 0.2 to about 2.0 weight percent.

Test Methods

Iodine Value (AOCS Method Cd 1-25) is determined by the Wijs method and expressed as the number of centigrams of iodine absorbed per gram of lubricant.

Viscosity is measured with a viscometer sold under the trademark BROOKFIELD® SYNCHRO-LECTRIC by Brookfield Engineering Laboratories, Inc., Stoughton, Mass.

pH is measured as a 5 weight percent dispersion in demineralized water using a pH meter.

% Varnish—Thin Film Oven Test—Several replicates of test finish(es) and control finish(es) are prepared by precisely weighing 0.30–0.35 grams of finish into previously weighed 57 mm aluminum weigh dishes. These dishes are randomly placed into 16"×9"×2" (41 cm×23 cm×5 cm) porcelain coated steel trays and placed in an electrically heated forced air oven. After heating at 225° C. for 16 hours, the trays are removed and allowed to cool to room temperature before reweighing the aluminum weigh dishes with finish residue. Then 10–20 grams of acetone are added to the weigh dishes to remove soluble residue. After standing for 10 minutes, the acetone is poured out of the weigh dish and any remaining acetone soluble residue is removed by rinsing with a stream of acetone from a squeeze bottle. The aluminum dishes are dried about 10 minutes in a 75° C. oven and cooled to room temperature before a final weighing of aluminum dishes to determine the percentage of acetone-insoluble varnish based on the original sample weight.

Size Kick-Out Test—Three grams of finish are added to a beaker containing a stirred solution of 5 grams of polyacrylic acid active size in 95 grams of water. After 5 minutes, stirring is stopped. After standing for one day, if a sticky film of size forms on the surface of or a sticky precipitate forms on the bottom of the size solution, the finish fails the size kick-out test.

EXAMPLE 1

Example Finishes A–D and Comparative

Example finishes A and B with the compositions listed in Table 1 are prepared by charging a vessel with all the components except the pentaerythritol tetrapelargonate lubricant and the potassium hydroxide (KOH). With mechanical stirring, the KOH is added as a 45% water solution to form the potassium isostearate soap in situ. The stirring is continued for an additional 10 minutes after the addition is complete to assure complete reaction. The pentaerythritol tetrapelargonate lubricant is then added slowly with stirring to complete the preparation of the neat oil finish.

Example finishes C and D with the components listed in Table 1 are prepared similarly. However, since these finishes contain no nonionic surfactant, a part of the pentaerythritol tetrapelargonate lubricant (equal to the isostearic acid weight) is added prior to the neutralization step which forms the soap in situ.

The finishes are subjected to a number of test procedures to predict performance in use and the results are reported in Table 2. The Comparative finish is a neat oil finish of the type which is used commercially and has the following composition:

69 weight percent coconut oil;

30 weight percent sorbitol ethoxylate esters (nonionic surfactant); and 1 weight percent hindered phenol antioxidant.

TABLE 1

| | Example Finish | | | |
|---|---|---|---|---|
| | A | B | C | D |
| Pentaerythritol Tetrapelargonate | 89.16 | 88.16 | 90.86 | 91.96 |
| Sorbitol/30EO/1Lauric/4Oleic | 5.0 | 5.0 | — | — |
| POE (14) Isostearate | — | — | 1.0 | — |
| Isostearic Acid | 5.0 | 5.0 | 7.0 | 7.0 |
| KOH (45 wt. % conc.) | 0.3 (.67) | 0.3 (.67) | 0.5 (1.11) | 0.5 (1.11) |
| Sodium Di-2-Ethylhexyl Sulfosuccinate (75 wt. % conc.) | — | 1.0 (1.33) | 0.1 (.13) | — |
| Trilauryl Phosphate | 0.5 | 0.5 | 0.5 | 0.5 |
| Polydimethyl Siloxane (50 cst viscosity) | 0.04 | 0.04 | 0.04 | 0.04 |

TABLE 2

| | Example Finish | | | | |
|---|---|---|---|---|---|
| | A | B | C | D | Comparative |
| Viscosity @ 30° C. | 48.0 | 54.9 | 53.5 | 50.0 | 71.0 |
| pH @ 5% Conc. | 9.30 | 9.15 | 9.58 | 9.66 | 6.07 |
| % Varnish | | | | | |
| 1 | 0.79 | 2.42 | 0.63 | 0.07 | 20.14 |
| 2 | 0.63 | 2.11 | 0.56 | −0.03 | 18.64 |
| 3 | 1.02 | 1.86 | 0.33 | 0.06 | 20.21 |
| 4 | 0.62 | 1.35 | 0.13 | 0.03 | 17.83 |

TABLE 2-continued

| | Example Finish | | | | |
|---|---|---|---|---|---|
| | A | B | C | D | Comparative |
| 5 | 0.79 | 3.21 | 0.56 | 0.00 | 16.96 |
| 6 | 0.36 | 2.49 | 0.36 | 0.03 | 18.81 |
| Av. | 0.70 | 2.42 | 0.43 | 0.03 | 18.76 |
| Size Kick-Out Test | Fail | Pass | Pass | Pass | Fail |

EXAMPLE 2

Finish D is used as a spin finish for making a 1260 denier, ~9.8 gpd tenacity, 66 nylon industrial yarn using the process described in U.S. Pat. No. 3,311,691. The finish is applied at a temperature of about 80° C. in the amount of about 1.0% by weight. Good spinning performance, i.e., no adverse effect on spinning breaks or broken filaments, is observed.

I claim:

1. A synthetic filament selected from the group consisting of polyamide homopolymers and copolymers and polyester homopolymers and copolymers, said filament is drawn or drawable and is coated with a lubricating finish composition comprising:

about 80 to about 99 weight percent lubricant selected from the group consisting of natural and synthetic esters, said lubricant having a number average molecular weight of at least about 550 amu and having an iodine value of less than about 15; and about 1 to about a 20 weight percent sodium or potassium alkali metal salt of a branched or unbranched aliphatic monocarboxylic acid having at least 8 carbon atoms, said finish composition is a homogenous liquid at a temperature below about 150° C.

2. The filament of claim 1 wherein said finish composition comprises:

about 85 to about 98 weight percent of said lubricant; and about 2 to about 15 weight percent of said alkali metal salt of a branched or unbranched aliphatic monocarboxylic acid having at least 8 carbon atoms.

3. The filament of claim 1 wherein said branched or unbranched aliphatic monocarboxylic acid of said salt has at least 14 carbon atoms.

4. The filament of claim 1 wherein said finish composition further comprises an antioxidant in an amount of about 0.05 to 5 weight percent.

5. The filament of claim 1 wherein said finish composition is free of nonionic surfactant.

6. The filament of claim 1 wherein said finish is present on said filament in an amount of about 0.2 to about 2.0 weight percent.

7. A process for applying a finish lubricating composition to a synthetic filament selected from the group consisting of polyamide homopolymers and copolymers and polyester homopolymers and copolymers, said filament is drawn or is drawable, said process comprising coating said filament with a finish composition as a neat oil, said finish composition comprising:

about 80 to about 99 weight percent lubricant selected from the group consisting of natural and synthetic esters, said lubricant having a number average molecular weight of at least about 550 amu and having an iodine value of less than about 15; and about 1 to about 20 weight percent sodium or potassium alkali metal salt of a branched or unbranched aliphatic monocarboxylic acid having at least 8 carbon atoms, said finish composition is a homogenous liquid at a temperature below about 150° C.

8. The process of claim 7 wherein said composition comprises:

about 85 to about 98 weight percent of said lubricant; and about 2 to about 15 weight percent of said alkali metal salt of a branched or unbranched aliphatic monocarboxylic acid having at least 8 carbon atoms.

9. The process of claim 7 wherein said branched or unbranched aliphatic monocarboxylic acid of said salt has at least 14 carbon atoms.

10. The process of claim 7 wherein said composition further comprises an antioxidant in an amount of about 0.05 to 5 weight percent.

11. The process of claim 7 wherein said composition is free of non-ionic surfactant.

12. The process of claims 7 wherein said finish composition is coated on said filament at a temperature of about 25° C. to about 150° C.

13. The process of claim 7 wherein said finish composition is coated at a said filament temperature of about 50° C. to about 100° C.

14. The process of claim 7 wherein said finish is applied to said filament in an amount of about 0.2 to about 2.0 weight percent.

15. The process of claim 7 wherein said filament is drawn subsequently to said coating with said finish composition.

* * * * *